United States Patent [19]

Walker et al.

[11] 4,380,095

[45] Apr. 19, 1983

[54] AUTOMATIC FIBER BLENDER

[75] Inventors: Jesse P. Walker; William H. Robertson, both of Union, S.C.

[73] Assignee: Milliken Research Corporation, Spartanburg, S.C.

[21] Appl. No.: 209,471

[22] Filed: Nov. 24, 1980

[51] Int. Cl.[3] ..... D01G 7/06

[52] U.S. Cl. ..... 19/80 R; 19/81; 19/145.5

[58] Field of Search ..... 19/80 R, 145.5, 81

[56] References Cited

U.S. PATENT DOCUMENTS

| | | | |
|---|---|---|---|
| 3,110,062 | 11/1963 | Wildbolz et al. | 19/80 R |
| 3,208,106 | 9/1965 | Leineweber et al. | 19/80 R |
| 3,820,197 | 6/1974 | Jeanmaire | 19/80 R |
| 3,945,085 | 3/1976 | Katoh et al. | 19/80 R |
| 4,117,571 | 10/1978 | Prather | 19/80 R |
| 4,259,765 | 4/1981 | Trützschler | 19/80 R |
| 4,297,766 | 11/1981 | Trützschler | 19/80 R |

*Primary Examiner*—Louis Rimrodt

*Attorney, Agent, or Firm*—Earle R. Marden; H. William Petry

[57] ABSTRACT

This invention is directed to a fiber blending machine which takes amounts of fiber from a plurality of bales to provide a uniform blend of fibers. The machine is provided with an automatic apparatus to apply pressure to the top of nearly exhausted bales to ensure that fibers are plucked therefrom as they are reciprocated back and forth across the plucking area of the machine.

7 Claims, 3 Drawing Figures

AUTOMATIC FIBER BLENDER

This invention relates to an apparatus for removing layers of fiber or the like from a bale by the use of a plucking device over which the bales of fiber are reciprocated. In the use of this type of device when the depth of the bale has been reduced to a minimum, it is difficult to complete the plucking of the bale unless the reduced bale is forced downwardly towards the fiber plucking area.

Therefore, it is an object of the invention to provide an apparatus to blend fiber from a plurality of bales which incorporate mechanism to ensure complete consumption of the bales of fibers being supplied to the apparatus.

Other objects and advantages of the invention will become readily apparent as the specification proceeds to describe the invention with reference to the accompanying drawings in which.

Figure 1:
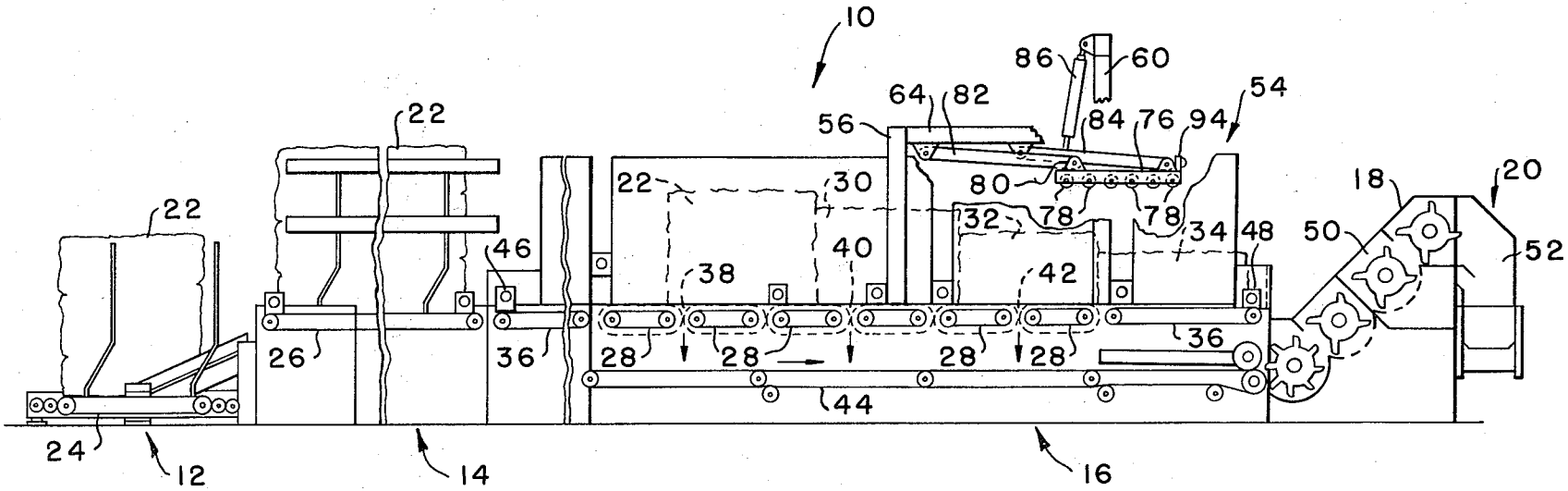
FIG. 1 is a side elevation view of the new and improved fiber blending machine.

Looking now to FIG. 1, the operation of the over-all apparatus will be explained.

The machine, generally designated 10, consists of five basic sections which are the bale lifter section 12, the reserve bale conveyor section 14, the bale plucking section 16, the step cleaner section 18 and the blending conveyor section 20. In operation, the bales 22 of fiber are conveyed successively through the sections 12 to 20.

Initially, a bale 22 of fibers is freed from all of its steel bands except for the first and last one, and, by suitable means, is lifted to the lowered bale lifter conveyor 24. The bale lifter conveyor 24, by a suitable mechanism, not shown, is lifted to the level of the bale conveyors 26 of the reserve bale conveyor section 14 and the bale loaded thereon.

The reserve bale conveyor section 14 can accommodate as many bales as the length thereof is designed for. The length of the reserve bale conveyor section 14 is normally designed to hold a sufficient number of bales to accommodate a three shift operation without reloading. From the conveyors 26 in the reserve bale conveyor section 14, bales 22 are either manually or automatically supplied to the spiked conveyors 28 of the bale plucking section 16 of the machine 10.

Preferably, when initially loading the machine 10, the plucking section 16 is loaded with a plurality of stepped bales 22, 30, 32 and 34 so that the bale 34 adjacent the outlet of the plucking section 16 is lower in height than the next adjacent bales. Once loaded, the conveyor 26 will supply a full bale 22 to the spiked conveyor 28 when the bale 34 has been exhausted.

As briefly discussed, the plucking section 16 has a plurality of spiked conveyors 28 and at each end has a smooth reversing conveyor 36. The spiked conveyors 28 are adjacent each other with the spikes on adjacent conveyors inclined in a direction opposite to each other so as to form plucking points 38, 40 and 42. The spikes in one conveyor adjacent another conveyor are offset by a half-pitch so that they will pass through the gaps between the spikes on the adjacent conveyor. In conventional manner the spiked conveyors peel off thin layers from the bottom of the bales and discharge the peeled off fibers through the plucking points 38, 40 and 42 where the spikes of adjacent conveyors face one another. The fibers discharged through the plucking points drop onto the blending conveyor 44 in superimposed manner and are built-up on the conveyor 44 as the operation of the conveyors 28 and 36 are reversed by the action of the electric eyes 46 and 48 at the ends of the plucking section 16. From the blending conveyor the plucked or peeled fibers are delivered in conventional manner to the step cleaner 50 and from there onto the blending conveyor 52.

In the operation of the plucking section 16, it has been found that when the height of the last bale 34 is reduced to a minimum, the fiber therefrom is not handled properly by the spikes on the conveyor 28 and the operator then has to manually feed the remaining portion of the bale into the conveyor 44. To eliminate this hazardous and time consuming job, a press roll arrangement, generally designated 54, is employed to press on the top of the bale 34 when it is reduced to a certain height to press the fibers towards the spiked conveyor 28 and the plucking or discharge point 42.

Figure 2:
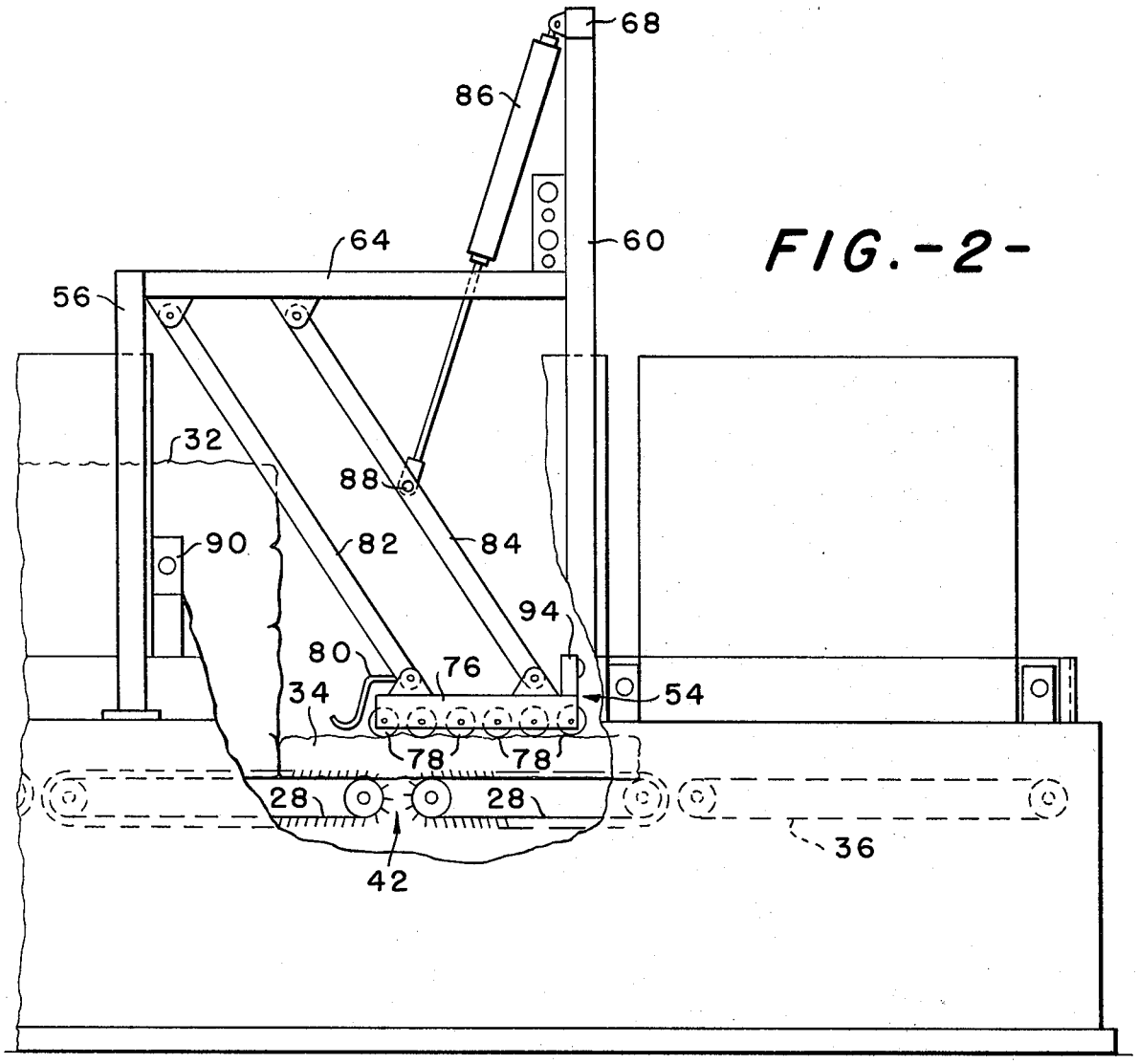
FIG. 2 is a blown up, cut away, elevation view of the fiber blending area of the machine shown in FIG. 1; and, FIG. 3 is a top view of the apparatus shown in FIG. 1.
Figure 3:
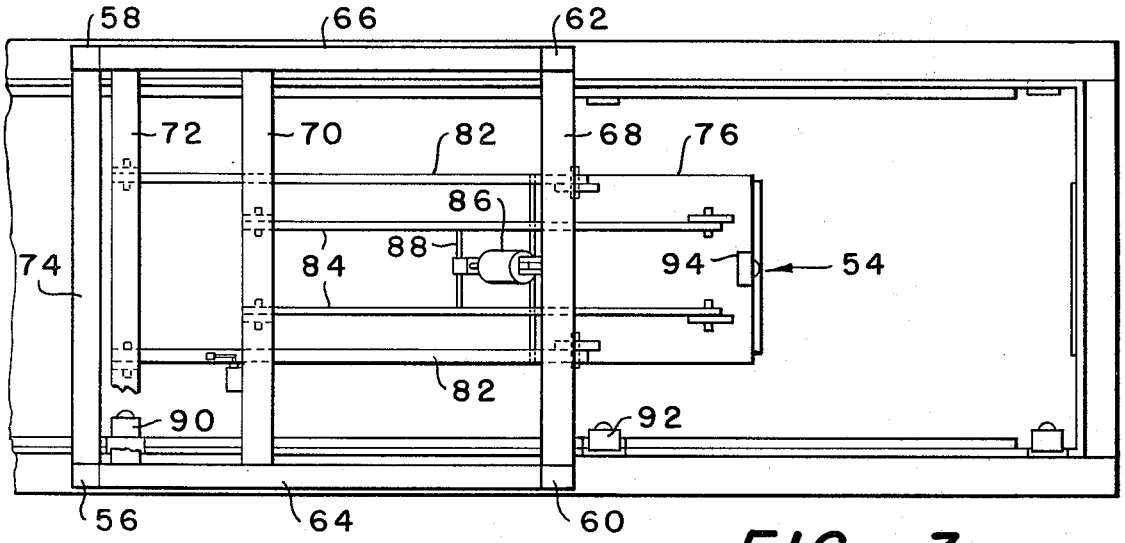

The press roll arrangement 54, shown in detail in FIGS. 2 and 3, is pivotally mounted to superstructure, welded or otherwise secured to the top of the plucking section. The superstructure consists of upright beams 56 and 58 at one end and taller upright beams 60 and 62 at the other end. Interconnecting the beams 56 to the beams 58 are connecting beams 64 and 66, respectively. A cross beam 68 interconnects the two taller upright beams 60 and 62 while beams 70 and 72 interconnect the connecting beams 64 and 66, respectively. Another cross beam 74 connects the two upright beams 56 and 58.

The press roll arrangement 54 consists of a rectangular box shaped frame 76 on which are mounted a plurality of rolls 78, a switch 80, two pairs of arms 82 and 84 and an air piston 86. The arms 82 are pivotally connected at one end to cross beam 72 and at the other end to the top of the frame 76. The arms 84 are pivotally mounted at one end to the cross beam 70 and at the other end are also pivotally secured to the top of the frame 76. The air activated piston is pivotally secured at one end to a cross member 88 connected between the arms 84 and at the other end to the cross beam 68.

As shown in FIG. 2, the press roll arrangement rides on the low profile bale 34 to press the bale 34 towards the spiked conveyor 28. When the bale 34 has been exhausted, the bale 32 is indexed over the plucking point 42 and will initially hit the switch 80 to actuate the air valve (not shown) to cause the piston 86 to raise the box frame 76 to the position shown in FIG. 1. An electric eye 90 (FIGS. 2 and 3) is mounted above and slightly behind the press roll assembly 54 to maintain the press roll assembly in the up position until the height of the bale is reduced to the point where light from the electric eye is picked up by its receptor to allow the piston 86 to lower the box frame 76 to its operative position. To prevent the box frame 76 from lowering when there is no fiber stock present over the plucking point 42 an additional electric eye 92 (FIG. 3) is mounted adjacent the plucking point 42. A further electric eye 94 is mounted on the front of box frame 76 to cooperate with a pick-up on the front of the step cleaner section 18 to prevent the box frame 76 from lowering if a tall bale has passed over the plucking point 42 and the lowering of the box frame 76 will strip fibers off the top of the bale.

The box frame is allowed to free fall as the actuated air valve (not shown) allows the air from the piston 86 to exhaust and the weight of the press roll arrangement acts as an additional mass to help press the fiber stack against the spiked conveyor. When the air valve (not shown) supplies air to the piston 86 the box frame 76 is raised.

It can readily be seen that a fiber handling machine has been described which will ensure that all the fiber in the system will be handled automatically without close maintenance of an operator and at the same time provide automatic safeguards to prevent damage to elements of the machine.

Although we have described specifically the preferred embodiment of the invention, it is contemplated that changes may be made without departing from the scope or spirit of the invention and we desire to be limited only by the scope of the claims.

We claim:

1. Apparatus to automatically pluck fibers from a plurality of bales comprising: a conveyor system including a plurality of conveyors, means to drive adjacent conveyors in directions opposite to one another, a first means holding a weighted member above said conveyor system in an inoperative position and a second means operably associated with the last conveyors of said conveyor system to sense the height of a bale of fibers in said conveyor, said first means including a means to automatically lower said weighted member from its inoperative position onto the top of a bale on said conveyor when said second means detects that the height of the bale is below a predetermined minimum.

2. The apparatus of claim 1 wherein said weighted member includes a switch means thereon to raise the weighted member when contacted by a bale of fibers above a pre-determined height.

3. The apparatus of claim 1 wherein said weighted system includes a rectangular inverted box member with a plurality of rolls mounted thereon.

4. The apparatus of claim 3 wherein said weighted system includes a plurality of lever arms pivotally connected thereto and to a superstructure mounted thereabove.

5. The apparatus of claim 4 wherein said weighted system includes an air actuated piston to pivot said box member away from said conveyor when the bales of fibers thereon exceed a pre-determined height.

6. The apparatus of claim 5 wherein said weighted system includes an electric eye to detect the height of bales of fibers on the conveyor system.

7. The apparatus of claim 6 wherein said weighted member includes a switch means thereon to raise the weighted member when contacted by a bale of fibers above a pre-determined height.

* * * * *